US005695239A

United States Patent [19]

Johnson et al.

[11] Patent Number: 5,695,239

[45] Date of Patent: Dec. 9, 1997

[54] SEATING FURNITURE OTTOMAN

[75] Inventors: Terry D. Johnson, Tupelo; John T. Gory, Sherman; Greg M. Lawson; Dennis M. Golden, both of Tupelo, all of Miss.

[73] Assignee: Super Sagless Corporation, Tupelo, Miss.

[21] Appl. No.: 607,146

[22] Filed: Feb. 26, 1996

Related U.S. Application Data

[63] Continuation of Ser. No. 155,110, Nov. 19, 1993, abandoned.

[51] Int. Cl.[6] ..... A47C 7/50

[52] U.S. Cl. ..... 297/69; 297/89; 297/423.25

[58] Field of Search ..... 297/69, 85, 89, 297/423.3, 423.25, 423.26

[56] References Cited

U.S. PATENT DOCUMENTS

| | | | |
|---|---|---|---|
| 3,004,791 | 10/1961 | Schliephacke | 297/85 |
| 3,348,878 | 10/1967 | Rogers | 297/68 |
| 4,740,031 | 4/1988 | Rogers, Jr. | 297/85 |
| 4,861,101 | 8/1989 | Hartline | 297/69 |
| 5,064,244 | 11/1991 | Sproule | 297/85 X |
| 5,137,328 | 8/1992 | Smith et al. | 297/85 |
| 5,368,366 | 11/1994 | Mizelle | 297/423.3 |

FOREIGN PATENT DOCUMENTS

| | | | |
|---|---|---|---|
| 647675 | 8/1962 | Canada | 297/85 |
| A 22 21 542 | 11/1973 | Germany . | |
| 803673 | 10/1958 | United Kingdom | 297/85 |
| 847946 | 9/1960 | United Kingdom | 297/85 |
| 1442338 | 7/1976 | United Kingdom | 297/89 |

*Primary Examiner*—Peter M. Cuomo
*Assistant Examiner*—David E. Allred
*Attorney, Agent, or Firm*—Craig J. Lervick; Jennifer K. Farrar

[57] ABSTRACT

A hardware assembly for mounting a retractable ottoman on a seating unit frame below the front edge of an occupant support cushion. The assembly includes a frame bracket having a plate and an underlip, the frame and underlip each carrying a flange, the flanges are generally perpendicular to the plate and together carry a first pivot and a second pivot positioned below and rearward of the first pivot. The assembly also includes an ottoman bracket having a pair of pivots. A lazy tong linkage connects the brackets and locks in a horizontal extended position. The assembly may be optionally spring driven to facilitate deployment of an ottoman on the ottoman bracket.

13 Claims, 6 Drawing Sheets

SEATING FURNITURE OTTOMAN

This is a continuation of prior application Ser. No. 08/155,110, filed Nov. 19, 1993, now abandoned.

BACKGROUND OF THE INVENTION

The present invention relates generally to seating units such as chairs and sofas and in particular relates to seating units having retractable ottomans.

Upholstered foot stools or free standing ottomans have long been used in conjunction with seating units such as sofas, loveseats or chairs. One drawback of the traditional free-standing ottoman is the loss of floor space associated with such furniture. This drawback has become more pronounced as the price of housing and floor space rises. This disadvantage has been overcome by the development of retractable ottomans on certain seating units. For example, most motion furniture, such as reclining or inclining chairs, loveseats or sofas, incorporate a retractable ottoman. It would be advantageous to provide a retractable ottoman feature on a sofa or non-reclining chair.

One recent solution to this problem is disclosed in U.S. Pat. No. 4,861,101 of Hartline. The Hartline mechanism involves a sofa-ottoman assembly with a lazy tong linkage connecting a first bracket, which can be mounted on the front rail of a sofa, to a second bracket, which can support an ottoman, and an actuating assembly, involving links, levers and a side rail mounted handle. The particular lazy-tong linkage of Hartline features a narrow side profile which allows space for a folding bed frame and mattress within the sofa frame. Thus, the Hartline mechanism promised a substantial advance in this art. However, the narrow side profile of the Hartline lazy tong linkage suffers a serious shortcoming in that the fully folded narrow profile position is in a "neutral" mode which typically results in some difficulty initiating the action of extending the ottoman. The Hartline lazy tong linkage is also characterized by another shortcoming: a tendency toward accelerated wear upon the pivots because of the substantial force required to dependably initiate action from the "neutral" mode. Further, the Hartline ottoman mechanism remains limited to certain mounting positions, specifically the seating positions directly associated with arms of the seating unit. In other words, the Hartline ottoman is not applicable to the center seating position(s) of a sofa with three or more seating positions.

Considering the various shortcomings of the Hartline retractable ottoman, a more versatile retractable ottoman mechanism is still needed by the furniture industry. Preferably, the desired versatile ottoman mechanism would be less costly to manufacture, involve fewer or less complex components, and/or incorporate more durability. These considerations are addressed by the present invention as explained below.

SUMMARY OF THE INVENTION

The present invention is in one embodiment a hardware assembly for mounting a retractable ottoman on a seating unit frame below the front edge of an occupant support cushion. The assembly includes a frame bracket having a plate and an underlip, the frame and underlip each carrying a flange, the flanges are generally perpendicular to the plate and together carry a first pivot and a second pivot positioned below and rearward of the first pivot. The assembly also includes an ottoman bracket with a pivot, preferably having a pair of pivots. A lazy tong linkage connects the brackets and locks in a horizontal extended position. The mechanism's lock is released by slight rearward motion of the ottoman. The assembly may be optionally spring driven to facilitate deployment of an ottoman on the ottoman bracket.

More specifically, the invention is a hardware assembly for mounting a retractable ottoman on a seating unit frame below the front edge of an occupant support cushion, the assembly including a frame bracket having a first pivot and a second pivot positioned below the first pivot; an ottoman bracket; and a lazy tong linkage (preferably a pair of linkages) interconnecting the frame bracket and the ottoman bracket. The lazy tong linkage includes: an upper rear lever pivotally connected to the first pivot of the frame bracket, a lower rear lever pivotally connected to the second pivot of the frame bracket, a front lever pivotally attached to the upper and lower rear levers and carrying the ottoman bracket. The invention also includes means for locking the lazy tong linkage in an extended position. The lock means is released by slight rearward movement of the ottoman, i.e. compressing the lazy tong linkage. In a preferred embodiment, a means for controlling attitude (i.e. horizontal or vertical) of the ottoman bracket of the ottoman includes a second front lever pivotally attached to the ottoman bracket and pivotally attached to the lower rear lever. Alternatively, this attitude control could be accomplished by a sliding lock or a hand adjusted tightening control to lock the ottoman in a horizontal position or attitude. The hardware assembly's means for locking may include a means for limiting motion through interaction between the upper rear lever and the front lever. Specifically, the means for limiting may include a projection on the front lever which prevents passage of the upper rear lever. Most preferably, when limited, the central pivots of the lazy tong mechanism are in a near over center condition or relationship.

The assembly further may include a mid-ottoman board bracket and/or a cross tube. The invention also includes a seating unit, sofa, love seat or chair including an ottoman carried by the hardware assembly.

BRIEF FIGURE DESCRIPTIONS

DETAILED DESCRIPTION OF THE PREFERRED EMBODIMENTS

Figure 1:
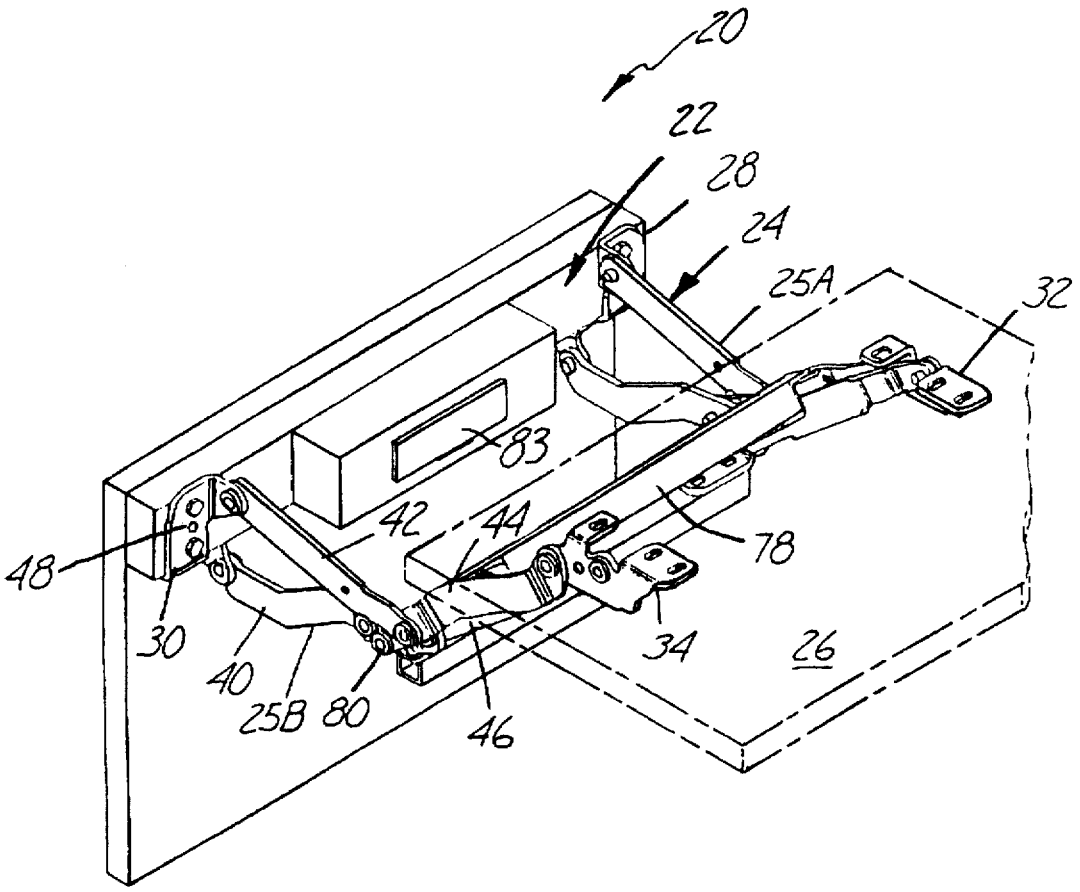
FIG. 1 is a perspective view of a mechanism of the present invention in an extended position and showing a portion of an ottoman board in outline.

With reference to FIG. 1, a first embodiment of the present invention 20 involves a seating unit, such a sofa, love seat, or chair, having a frame with a generally vertically-oriented front surface 22; and also includes a hardware assembly 24; and an ottoman board 26. As is well known in this art, such a frame surface 22 is typically present in seating units in the form of a forward directed face of a front rail positioned immediately below the front edge of a seat cushion and, for ease of understanding of the invention 20 in the following description, the seating unit frame may be considered as represented by front rail surface 22.

The hardware assembly 24 includes paired lazy tong mechanisms 25A & 25B connecting right and left frame brackets 28 and 30 and right and left ottoman brackets 32 and 34, respectively. The paired lazy tong mechanisms 25A & 25B are preferably mirror images of each other and, for ease of explanation in the following description, only the left mechanism 25B will be described in detail.

The lazy tong linkage mechanism 25B includes lower rear lever 40 and upper rear lever 42. The mechanism 25B further includes upper front lever 44 and lower front lever 46.

With reference to the left frame bracket 30, the bracket 30 includes a plate 48, with a underlip portion 50. Preferably, the plate 48 is vertically positioned, attached to the seating unit frame, and contacts the front rail surface 22. Preferably, underlip portion 50 is horizontally positioned and contacts the adjoining lower face of the front frame rail 22. Attachment of the bracket 30 may be by fastening with common fasteners such as for example, wood screws, lag bolts or through bolting. A pair of flanges 52 and 54 project generally perpendicular to the rail surface 22 from the plates 48 and 50 and are both oriented generally vertically. Preferably, the flanges 52 and 54 are not co-planar, but rather slightly offset. The flanges 52 and 54 carry rivet pivots 53 and 55. Other suitable pivot connectors may be substituted, however, rivets are preferred as the best compromise for durability, cost, and ease of assembly in a modern fabrication facility. The flange 52 projecting from the plate 48 pivotally carries a first end of upper rear lever 42 at pivot 53 and flange 54 carries a first end of lower rear lever 40 at pivot 55. Because of the position of underlip portion 50 under the front rail, the pivot point 55 for lower rear lever 40 lies both below and rearward of the pivot point 53 of upper rear lever 42 on flange 52. As will be discussed in further detail below, this relationship of pivots 53 and 55 on frame bracket 30 is significant for ease of deployment and durability.

At the opposite end of upper rear lever 42 is a pivot connection 60 to upper front lever 44. The specific location of pivot connection 60 is intermediate a lower pivot connection 62 connecting upper front lever 44 to an intermediate point on lower rear lever 40 and a pivot connection to the ottoman bracket 34. Pivot connection 62 connecting upper front lever 44 to lower rear lever 40 is intermediate pivot connection 55 and pivot connection 74 which connects the opposite end of lower rear lever 40 to lower front lever 46.

The opposite (upper) end of lever 44 is pivotally connected to a flange 70 of ottoman bracket 34 at pivot 63. The flange 70 is in turn rigidly attached in a generally perpendicular relationship to a plate 72 which carries the ottoman board 26.

Lower front lever 46 extends from pivot connection 74 connecting the lower end of lower front lever 46 to the end of lower rear lever 40. At its upper end, lower front lever 46 is pivotally connected to flange 70 at pivot 65. Preferably, the pivotal connection 65 between lower front lever 46 and flange 70 of ottoman bracket 34 is roughly centered on the ottoman bracket 34 and forward of the pivot connection 63 between upper front lever 44 and ottoman bracket 34.

Additionally, the hardware assembly 24 preferably includes a stabilizer cross-tube 76 which serves to couple the right and left sides of the lazy tong linkage mechanism 25A & 25B. Most preferably, the stabilizer cross-tube 76 is mounted to lower rear lever 40 between pivots 62 and 74 on the left side lazy tong linkage 25B and its mirror image lower rear lever on the right side lazy tong linkage 25A. Preferably, a mid-ottoman bracket 78 also extends between upper front lever 44 and its right hand mirror image component. The mid-ottoman board 78 promotes safety of the mechanism by reducing the likelihood for children to accidentally become captured by the ottoman board 26 as it is retracted.

Figure 2:
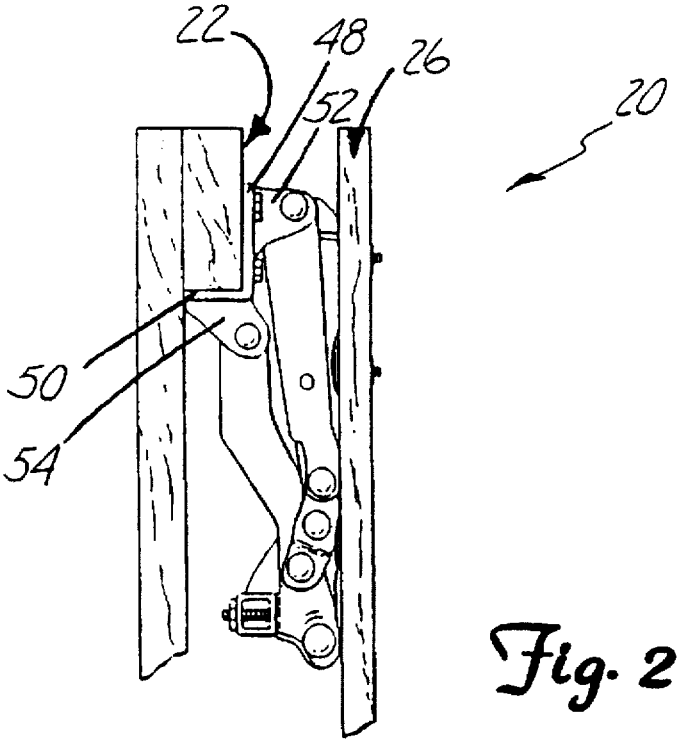
FIG. 2 is a side view of the mechanism of FIG. 1 in a retracted position.
Figure 3:
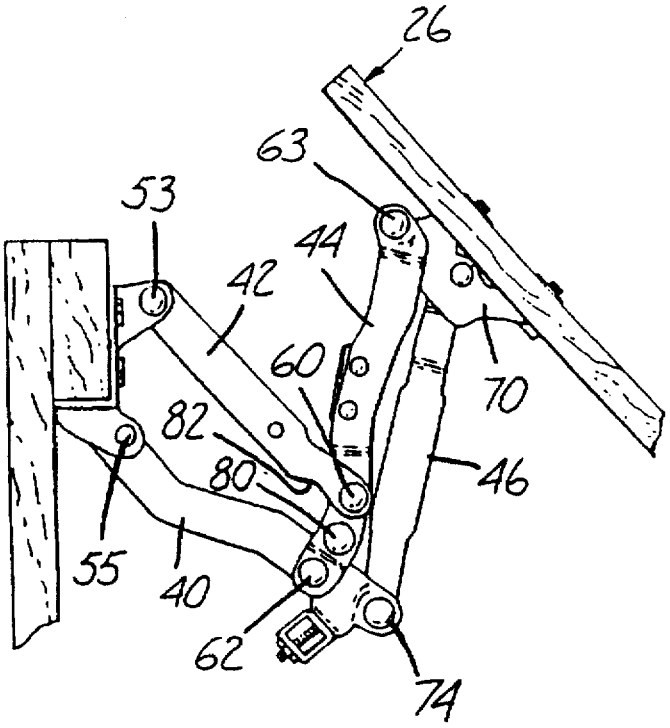
FIG. 3 is a side view of the mechanism of FIG. 1 in a partially extended position.
Figure 4:
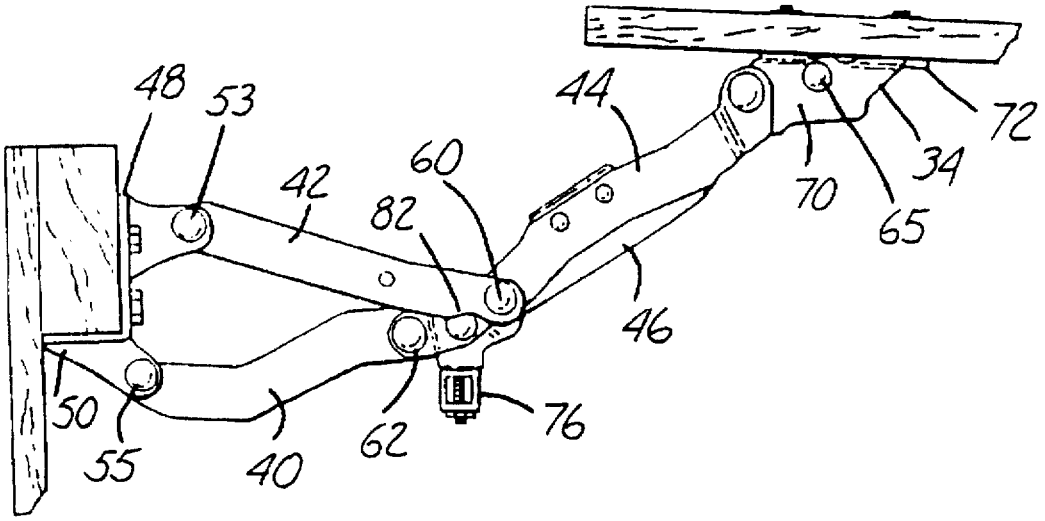
FIG. 4 is a side view of the mechanism of FIG. 1 in a fully extended position.
Figure 5:
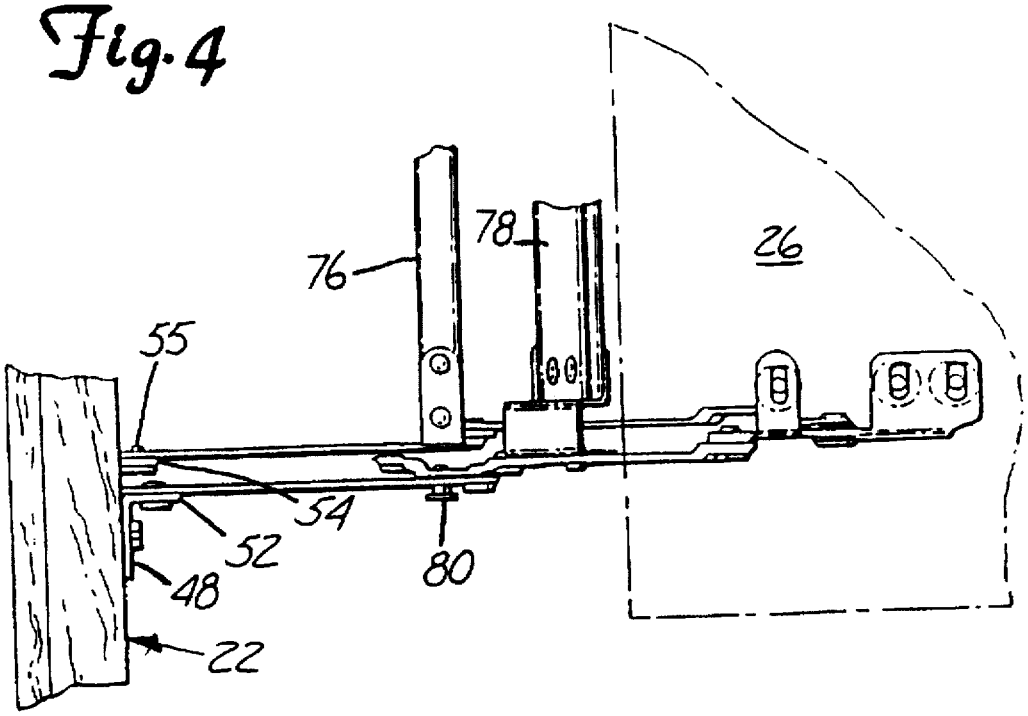
FIG. 5 is a top plan view of a portion of the mechanism of FIG. 1 in an extended position and showing a portion of a portion of an ottoman board in outline.

Additional understanding of the invention 20 may be gained from consideration of the movement of the ottoman board 26 as it is retracted from the full extended position, shown in FIGS. 1 and 4 as generally horizontal, through the intermediate position depicted in FIG. 3 to the fully retracted, generally vertical position, shown in FIG. 2. Specifically, to retract the ottoman board 26, a compression force, preferably including a slight downward force, is initially applied to the ottoman board 26, preferably forward regions of the ottoman board 26. By forward regions is meant those portions extended most distant from the occupant seating area. Application of such a force, or forces, easily move the ottoman board 26 generally toward the front rail surface 22 of the seating unit. After a slight amount of horizontal movement, the ottoman board 26 tends to rotate the ottoman bracket 32 from its initial horizontal extended position. As viewed from the left side, as in FIG. 4, the ottoman board 26 would rotate in a clockwise manner during retraction. This horizontal and rotational motion, in turn, causes the relative position of upper front lever 44 and lower front lever 46 to shift, such that lower front lever 46 is driven downward relative to upper front lever 44.

Because upper front lever 44 and lower front lever 46 are both pivotally connected to lower rear lever 40, lower rear lever 40 begins to rotate downward, pivoting from its connection 55 to the frame bracket 30. Upper rear lever 42 also rotates downward pivoting about its connection 53 to frame bracket 30. During such combined motion, the forward portion of the ottoman board 26 tends to drop faster than the rearward portion such that the ottoman board 26 rotates into a vertical orientation or attitude. Simultaneously with this rotation to a vertical attitude, the ottoman board 26 travels generally downward and rearward eventually coming to rest in a vertical and retracted position immediately in front of the front rail surface 22.

Because the lower pivot 55 of the frame bracket 48 is positioned not only below the upper pivot 53 of the frame bracket 30 but also rearward of the upper pivot 53, the corners of a rear trapezoid defined by pivot connections 53, 55, 60, and 62 are folded into a relatively compressed trapezoid. However, in contrast to the Hartline U.S. Pat. No. 4,861,101 (incorporated herein by reference) the rear trapezoid is not in a fully folded position which would be achieved with a parallelogram. Thus, there remains in this rear trapezoid the avoidance of a "neutral" or fully collapsed condition. This advantageous situation may be perhaps most easily understood by attribution to the location, (i.e. rearward and below) of rivet pivot connection 55. This situation of avoidance of a "neutral" condition, is sometimes termed "crank" in the motion furniture industry and allows this rearward trapezoid to be more easily unfolded with less binding and less stress placed upon the four pivots 53, 55, 60 and 74. Thus, durability is promoted by this aspect of the present invention 20.

In an extended position, shown in FIG. 4, the mechanism 24 may be viewed, as having the rear trapezoid changed to a rear triangle formed between the upper and lower pivots 53 and 55 of the frame bracket 30 and pivot connection 60. In this situation, a rigid condition is achieved in the leg of the triangle extending from pivot points 55 to 60, due to a near over-center condition generated at pivots 62 and 60. The over-center condition, however, is limited or locked by the addition of a motion limiting stud or projection 80 which interacts with upper rear lever 42 to prevent the rearward trapezoid from fully passing through the over center condition. Preferably, a notch 82 on the lower edge of upper rear lever 42 intercepts the limiting projection 80 to arrest the lazy tong linkage 25B at the near over center position, which corresponds to the fully extended ottoman condition shown in FIG. 4. In this condition, pivot 62 is very nearly in line with pivots 55 and 60 and projection 80 is in contact with notch 82. With reference to FIG. 4, a small horizontal compression movement, separates projection 80 from notch 82 to allow initiation of retraction of the ottoman board 26.

When the ottoman board 26 is fully extended, however, it is a remarkably stable projection from the rearward triangle and the upper forward lever 44 in all directions except with respect to a compression force. Thus, an occupant of the associated seating unit may rest their legs or feet on the ottoman board, especially when upholstered, with-substantial comfort. When they desire to retract the ottoman, a slight pull toward them will release it from its extended position. Such a pull can often be most conveniently accomplished by hooking one or both heels over the front edge of the ottoman and then pulling the heels slightly toward the occupant.

Further, lower front lever 46 may be viewed as controlling the attitude or orientation of the main ottoman bracket 34 by pivoting the bracket 34 into a horizontal position relative to its pivot connection 63 with upper front lever 44.

To facilitate securing the ottoman board 26 in the retracted position, a mechanical catch or fastener system 83 is preferably provided between the front rail surface 22 and the rearward underside of the ottoman board 26. Such a fastener system may be provided by a mechanical snap, a friction lock or most preferably a hook and pile fastener system.

When the ottoman is extended, as long as the occupant's foot or leg weight presses downward on the ottoman board 26, the ottoman board 26 will not retract. Shifting the force or weight of the occupants legs or feet to pull the ottoman board 26 toward the occupant, however, will cause the ottoman board 26 to easily retract.

To extend the ottoman board 26, it is manually pulled free from its retracted position and shifted to its extended position.

Figure 6:
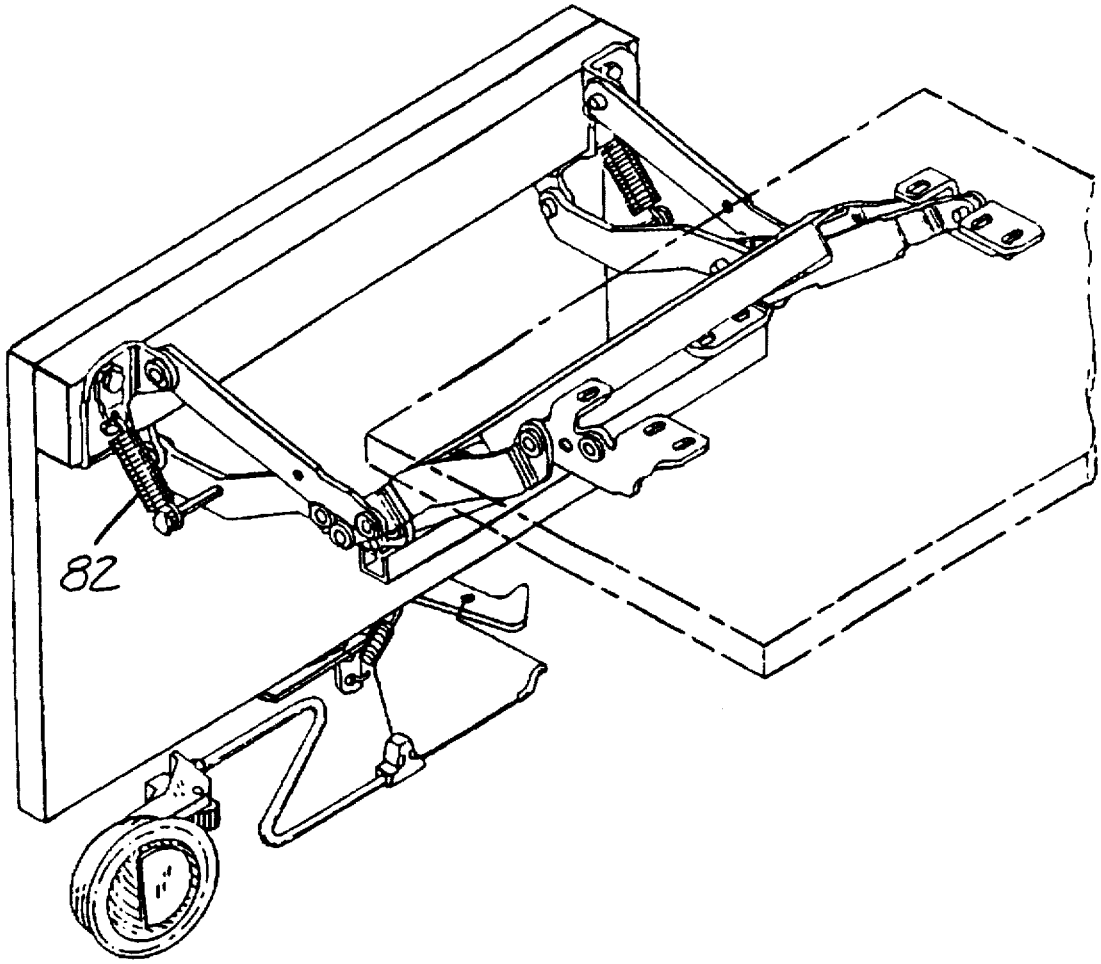
FIG. 6 is a perspective view of another embodiment of a mechanism of the present invention in an extended position and showing a portion of an ottoman board in outline.
Figure 7:
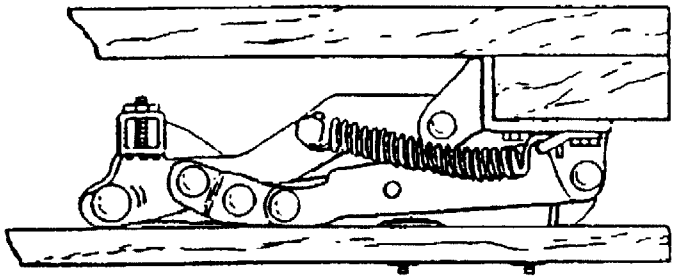
FIG. 7 is a side view of the mechanism of FIG. 6 in a retracted position.
Figure 8:
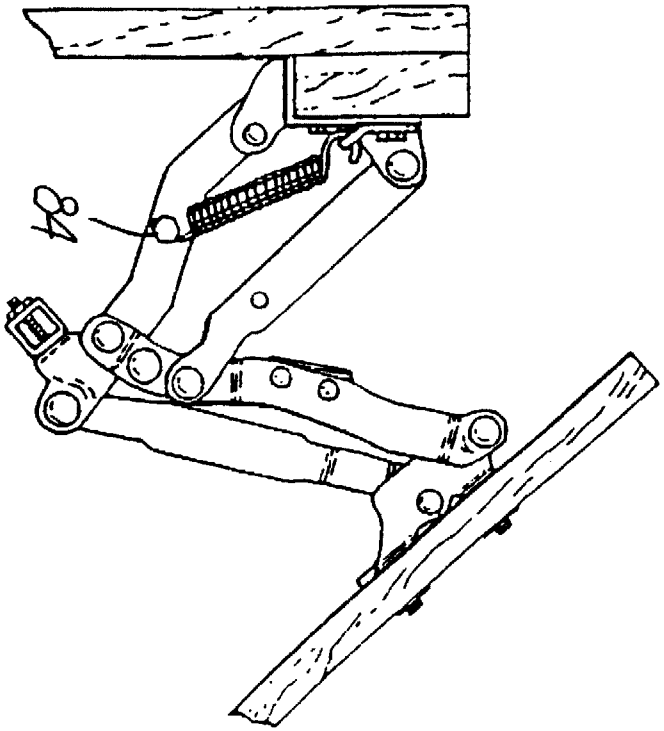
FIG. 8 is a side view of the mechanism of FIG. 6 in a partially extended position.
Figure 9:
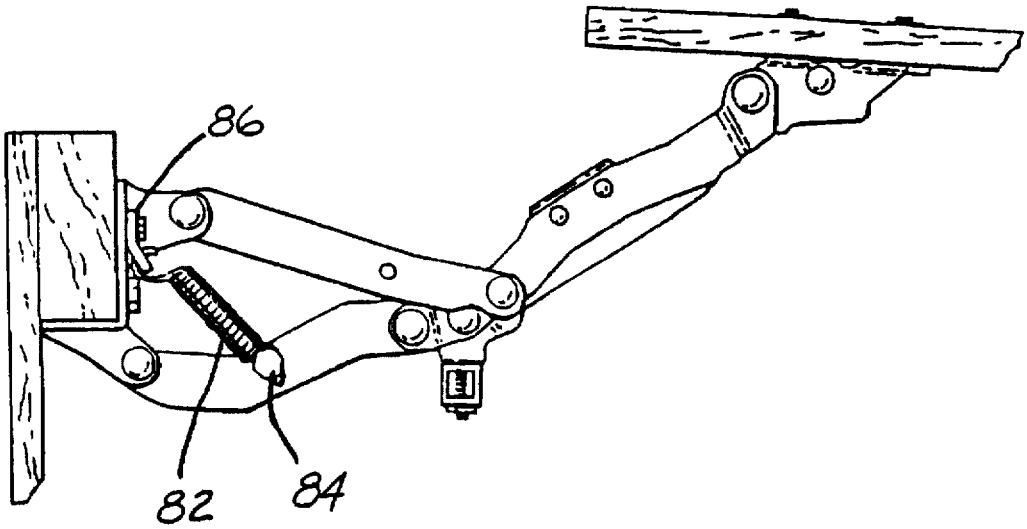
FIG. 9 is a side view of the mechanism of FIG. 6 in a fully extended position.
Figure 10:
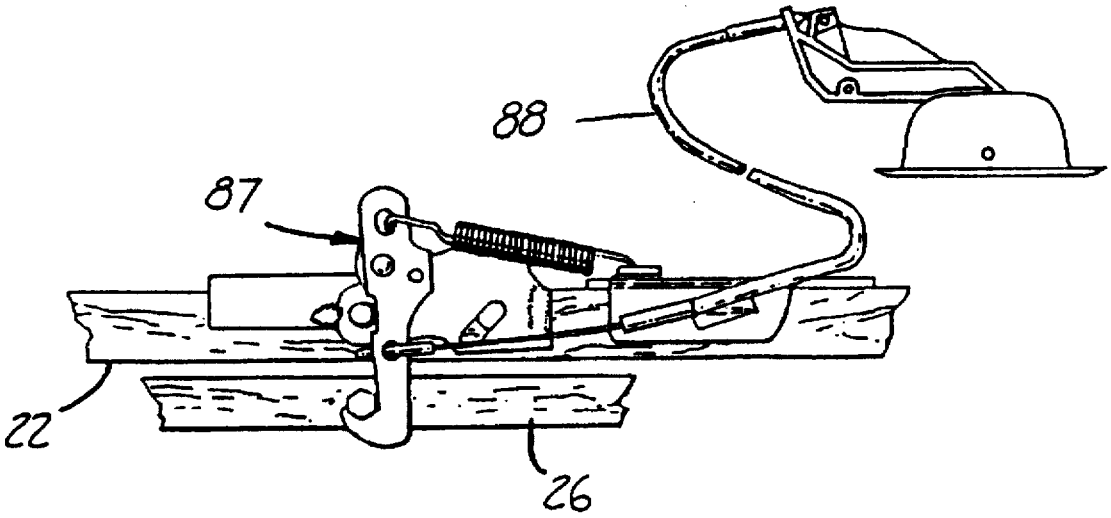
FIG. 10 is a bottom plan view of a portion of the mechanism of FIG. 6 in a retracted position.

In another embodiment, as shown in FIG. 6, a spring or similar tensioning device 82 is provided to urge motion of the lower rear lever 40 toward a horizontal extended position, shown in FIG. 9, from its retracted vertical position, shown in FIG. 7. Preferably, attachment of such a spring 82 may be provided by an anchor 84 located about midway on lower rear lever 40 and a tab 86 carried by a lag bolt fastener holding the frame bracket 30 to the front rail surface 22. Through a judicial selection of the tensioning device or spring 82, it is possible to select a spring 82 which will generate essentially little or no tension when the main ottoman board 26 has been moved into a full extended horizontal position. This facilitates subsequent retraction of the ottoman board 26 since the spring tension does not represent a serious impediment to the initial retracting motion of the ottoman board 26. It should be noted that initiation of retraction in the presence of a preferred spring 83 is nearly indistinguishable from that which is required in the springless embodiment earlier described herein. The tension of spring 82, however, becomes more noticeable as the fully retracted condition is approached.

Additionally, in this particular embodiment, it is generally necessary to provide a latch assembly 87 to hold the lower or outermost portion of the ottoman board 26 against the front frame surface 22. Preferably, a cable release mechanism 88 operates the latch assembly 87. The hand control of the cable release 88 can be located on an arm of the seating unit or other convenient location, such as the back.

Although the present invention has been described with reference to the preferred embodiments, workers skilled in the art will recognize that changes may be made in form and detail without departing from the spirit and scope of the invention.

What is claimed is:

1. A hardware assembly for mounting a retractable ottoman on a seating unit frame below an occupant support cushion, wherein the assembly is adapted to be mounted on a front portion of the frame for movement between extended and retracted positions, the assembly comprising:

a frame bracket having a first vertical leg and a second horizontal leg shorter than said first leg, said bracket having a first ear portion and a second ear portion, said first ear portion extending perpendicularly to a plane of said first leg and having a first pivot, a said second ear portion extending perpendicularly to a plane of said second leg and having a second pivot, said second pivot positioned below and to the rear of the first pivot;

an ottoman bracket;

lazy tong linkage interconnecting the frame bracket and the ottoman bracket and including:

an upper rear lever pivotally connected to the first pivot of the frame bracket, a lower rear lever pivotally connected to the second pivot of the frame bracket, a first front lever having a third and fourth pivot, wherein the first front lever is pivotally attached to the upper rear lever at the third pivot and to the lower rear lever at the fourth pivot and carrying the ottoman bracket, wherein the lazy tong linkage is extendable by manually pulling an ottoman board fixed to the ottoman bracket free from its retracted position;

means for controlling attitude of the ottoman bracket including a second front lever;

means for locking the lazy tong linkage in the extended position, wherein releasing is accomplished by applying a compression force in a rearward direction to the ottoman bracket, thereby causing the ottoman bracket to collapse into the retracted position; and wherein the entire hardware assembly is positioned forward of a rearmost portion of said frame bracket in both the extended and retracted positions.

2. The hardware assembly of claim 1 and wherein the means for controlling attitude of the ottoman includes said second front lever pivotally attached to the ottoman bracket and pivotally attached to the lower rear lever.

3. The hardware assembly of claim 2 and wherein the means for locking include a means for limiting downward motion of the ottoman bracket absent an initial compression movement.

4. The hardware assembly of claim 3 and wherein the means for locking includes a projection on the front lever between third and forth pivots which limits passage of the upper rear lever at a near over center relationship of the third and fourth pivots.

5. A hardware assembly for mounting a retractable ottoman on a seating unit frame below the front edge of an occupant support cushion, wherein the assembly is adapted to be mounted on a front portion of the frame for movement between extended and retracted positions, the hardware assembly comprising:

a frame bracket having a vertical plate and an underlip, the vertical plate and the underlip each carrying a flange, the flanges oriented generally perpendicular to the plate, the flange of the plate having a first pivot and the flange of the underlip having a second pivot positioned below and rearward of the first pivot;

an ottoman bracket having a plate and a flange generally perpendicular to the plate of the ottoman bracket, the plate having a first ottoman pivot;

lazy tong linkage interconnecting the frame bracket and the ottoman bracket including:

an upper rear lever pivotally connected to the first pivot of the frame bracket, a lower rear lever pivotally connected to the second pivot of the frame bracket, a first front lever pivotally attached to the upper and lower rear levers at a third and a fourth pivot, respectively, and pivotally attached at said first ottoman pivot to the ottoman bracket, and a second front lever pivotally connected to the ottoman bracket at a second ottoman pivot at a first end and pivotally connected at a fifth pivot to the lower rear lever at a second end wherein the lazy tong linkage is extendable by manually pulling an ottoman board fixed to the ottoman bracket free from its retracted position, and wherein the lazy tong linkage is released by applying the compression force in a rearward direction to the ottoman bracket; and projection means located on one of the levels for locking the lazy tong linkage in an extended position, wherein the projection means locks the linkage such that a near over center relationship is established between the third and fourth pivots; and wherein the entire hardware assembly is positioned forward of a rearmost portion of said frame bracket in the extended and retracted positions.

6. The assembly of claim 5 and further comprising a mid-ottoman board joined to the lazy tong linkage.

7. The assembly of claim 5 and wherein the projection means for locking includes a projection on the front lever engaging the upper rear lever.

8. The assembly of claim 7 and wherein the projection is located on the front lever intermediate the third and forth pivots.

9. The assembly of claim 5, wherein the assembly is one of a pair of assemblies carrying said ottoman board.

10. The assembly of claim 9 and wherein the pair of assemblies are interconnected by a stabilizer tube.

11. The assembly of claim 5 and further comprising means for holding the assembly in a retracted position.

12. A seating unit comprising the assembly of claim 5.

13. The assembly of claim 11 wherein first, second, third and fourth pivots are positioned such that crank in the linkage is provided when the linkage is fully retracted.

* * * * *

UNITED STATES PATENT AND TRADEMARK OFFICE

CERTIFICATE OF CORRECTION

PATENT NO. : 5,695,239
DATED : December 9, 1997
INVENTOR(S) : Terry D. Johnson et al.

It is certified that error appears in the above-identified patent and that said Letters Patent is hereby corrected as shown below:

Col. 2, line 67, between "such" and "a" insert --as--.

Col. 3, line 21, delete "a" (second occurrence) and insert therefor --an--.

Col. 4, line 8, between "mid-ottoman" and "bracket" insert --board--

Col. 4, line 10, after "board" insert --bracket--.

Col. 4, line 32, delete "turn," and insert therefor --turn--.

Col. 5, line 26, delete "with-" and insert therefor --with--.

Col. 5, line 47, delete "occupants" and insert therefor --occupant's--.

Col. 6, line 3, delete "83" and insert therefor --82--.

Signed and Sealed this

First Day of September, 1998

Bruce Lehman

*Attest:*

BRUCE LEHMAN

*Attesting Officer*

*Commissioner of Patents and Trademarks*